US010256551B2

(12) United States Patent
Shehan

(10) Patent No.: US 10,256,551 B2
(45) Date of Patent: Apr. 9, 2019

(54) HIGH GAIN, MULTI-BEAM ANTENNA FOR 5G WIRELESS COMMUNICATIONS

(71) Applicant: Amphenol Antenna Solutions, Inc., Rockford, IL (US)

(72) Inventor: Joshua W. Shehan, Hickory, NC (US)

(73) Assignee: Amphenol Antenna Solutions, Inc., Rockford, IL (US)

( * ) Notice: Subject to any disclaimer, the term of this patent is extended or adjusted under 35 U.S.C. 154(b) by 0 days.

(21) Appl. No.: 15/586,819

(22) Filed: May 4, 2017

(65) Prior Publication Data

US 2017/0324171 A1 Nov. 9, 2017

Related U.S. Application Data

(60) Provisional application No. 62/332,566, filed on May 6, 2016.

(51) Int. Cl.
*H01Q 21/00* (2006.01)
*H01Q 5/30* (2015.01)
(Continued)

(52) U.S. Cl.
CPC ..... *H01Q 21/0031* (2013.01); *H01Q 1/246* (2013.01); *H01Q 1/526* (2013.01);
(Continued)

(58) Field of Classification Search
CPC ..... H01Q 1/246; H01Q 1/526; H01Q 5/30; H01Q 21/0031; H01Q 25/00; H01Q 3/14; H01Q 15/08; H01Q 25/008
See application file for complete search history.

(56) References Cited

U.S. PATENT DOCUMENTS 3,392,394 A 7/1968 Caballero, Jr.
3,914,769 A 10/1975 Andrews
(Continued)

FOREIGN PATENT DOCUMENTS

EP 3012916 A1 4/2016
GB 1366259 A 9/1974
(Continued)

OTHER PUBLICATIONS

M. Letizia, et al., "Circularly Polarized Homogeneous Lens Antenna System Providing Multibeam Radiation Pattern for HAPS", The Radio Science Bulletin, No. 332, Mar. 2010, pp. 18-28.
(Continued)

*Primary Examiner* — Hoang V Nguyen
(74) *Attorney, Agent, or Firm* — Blank Rome LLP

(57) ABSTRACT

A high gain, multi-beam lens antenna system for future fifth generation (5G) wireless networks. The lens antenna includes a spherical dielectric lens fed with a plurality of radiating antenna elements. The elements are arranged around the exterior surface of the lens at a fixed offset with a predetermined angular displacement between each element. The number of beams and crossover levels between adjacent beams are determined by the dielectric properties and electrical size of the lens. The spherical nature of the dielectric lens provides a focal surface allowing the elements to be rotated around the lens with no degradation in performance. The antenna system supports wideband and multi-band operation with multiple polarizations making it ideal for future 5G wireless networks.

21 Claims, 18 Drawing Sheets

(51) Int. Cl.

| | |
|---|---|
| ***H01Q 1/24*** | (2006.01) |
| ***H01Q 1/52*** | (2006.01) |
| ***H01Q 25/00*** | (2006.01) |
| ***H01Q 3/14*** | (2006.01) |
| ***H01Q 15/08*** | (2006.01) |

(52) U.S. Cl.
CPC ..... *H01Q 3/14* (2013.01); *H01Q 5/30* (2015.01); *H01Q 15/08* (2013.01); *H01Q 25/00* (2013.01); *H01Q 25/008* (2013.01)

(56) References Cited

U.S. PATENT DOCUMENTS

| | | | | |
|---|---|---|---|---|
| 4,287,519 | A | 9/1981 | Doi | |
| 4,558,324 | A | 12/1985 | Clapp | |
| 5,421,848 | A | 6/1995 | Maier et al. | |
| 5,607,492 | A | 3/1997 | Doric | |
| 5,638,214 | A | 6/1997 | Doric | |
| 5,677,796 | A | 10/1997 | Zimmerman et al. | |
| 5,706,017 | A | 1/1998 | Büttgenbach | |
| 5,781,163 | A | 7/1998 | Ricardi et al. | |
| 6,266,029 | B1 * | 7/2001 | Lee | G06N 3/126 343/754 |
| 6,407,708 | B1 | 6/2002 | Jasper, Jr. | |
| 6,424,319 | B2 | 7/2002 | Ebling et al. | |
| 6,433,751 | B1 | 8/2002 | Ishitobi et al. | |
| 6,721,103 | B1 | 4/2004 | Strickland | |
| 6,864,837 | B2 | 3/2005 | Runyon et al. | |
| 7,151,508 | B2 | 12/2006 | Schaffner et al. | |
| 7,358,913 | B2 | 4/2008 | Ebling et al. | |
| 7,400,304 | B2 | 7/2008 | Lewis et al. | |
| 7,420,525 | B2 | 9/2008 | Colburn et al. | |
| 7,688,263 | B1 | 3/2010 | Oxley | |
| 8,518,537 | B2 | 8/2013 | Matitsine | |
| 8,848,295 | B2 | 9/2014 | Smith et al. | |
| 8,854,257 | B2 | 10/2014 | Hamner et al. | |
| 2003/0020652 | A1 | 1/2003 | Louzir et al. | |
| 2007/0296640 | A1 * | 12/2007 | Colburn | H01Q 19/062 343/783 |
| 2014/0104124 | A1 | 4/2014 | Chernokalov et al. | |
| 2015/0070230 | A1 | 3/2015 | Bradley et al. | |

FOREIGN PATENT DOCUMENTS

| | | | |
|---|---|---|---|
| JP | 2004080814 | A | 3/2004 |
| WO | WO-2015035400 | A2 | 3/2015 |

OTHER PUBLICATIONS

S. Jain, et al., "Broadband Flat-base Luneburg Lens Antenna for Wide Angle Scan", IEEE, 2014, pp. 771-772.
K. Gbele, et al., "Millimeter Wave Luneburg Lens Antenna Fabricated by Polymer Jetting Rapid Prototyping", International Conference on Infrared, Millimeter, and Terahertz Waves, 2014, 1 page.
P. Afanasyev, et al., "Multi-beam Luneburg Lens Antenna for Cellular Communications", 2015, 4 pages.
M. Liang, et al., "3D Printed Microwave and THz Components", IEEE, Dec. 2015, 2 pages.
Q. Jiang, et al., "A Multi-beam Cylindrical Lens Antenna Composed of Dielectric Mixtures", IEEE, 2015, pp. 90-92.
H. Feng Ma, et al., "Three-Dimensional Broadband and Broad-angle Transformation-Optics Lens", Nature Communications, 2010, 7 pages.
Y. Li, et al., "Beam Scanning Aray Based on Luneburg Lens", IEEE, 2014, 2 pages.
A. M. Sayeed, et al., "Continuous Aperture Phased MIMO: A New Architecture for Optimum Line-of-Sight Links", IEEE, 2011, pp. 293-296.
L. Matytsine, et al., "Large Size, Lightweight, Luneburg Lenses for Multi-beam Antenna Applications", 6th European Conference on Antennas and Propagation (EUCAP), IEEE, 2011, pp. 2266-2270.
J. Bor, et al., "Light and Cheal Flat Foam-Based Luneburg Lens Antenna", The 8th European Conference on Antennas and Propagation (EUCAP 2014), IEEE, 2014, pp. 3200-3204.
"Report on Steerable Antenna Architectures and Critical RF Circuits Performance", Information Society Technologies, FP6-IST-2003-506745 CAPANINA, 2006, 85 pages.
X. Gu, et al., "Enhancement of Angular Resolution of a Flat-Base Luneburg Lens Antenna by Using Correlation Method", Progess in Electromagnetics Research M, vol. 37, pp. 203-211, 2014.
B. Schoenlinner, et al., "Wide-Scan Spherical-Lens Antennas for Automotive Radars", IEEE Transactions on Microwave Theory and Techniques, vol. 50, No. 9, Sep. 2002, pp. 2166-2175.
S. Rondineau, et al., "A Sliced Spherical Lüneburg Lens", IEEE Antennas and Wireless Propagation Letters, vol. 2, 2003, pp. 163-166.
B. Xiang, et al., "Multi-beam Antenna at Q Band", IEEE, 2009, 2 pages.
G. Liu, et al., "A Study on Circular Polarization Multi-beam Antenna at Ka Band", IEEE, 2010, pp. 41-44.
A. Sayeed, et al., "Continuous Aperture Phased MIMO: Basic Theory and Applications", Forty-Eighth Annual Allerton Conference, Allerton House, UIUC, Illinois, September-October, IEEE, 2010, pp. 1196-1203.
M. Liang, et al., "An X-Band Luneburg Lens Antenna Fabricated by Rapid Prototyping Technology", IEEE, 2011, 4 pages.
J. Bor, et al., "Foam Based Luneburg Lens Antenna at 60 GHz", Progress in Electromagnetics Research Letters, vol. 44, 2014, pp. 1-7.
X. Gu, et al., "DOA Estimation by Using Luneburg Lens Antenna with Mode Extraction and Signal Processing Technique", Progress in Electromagnetics Research C, vol. 56, 2015, pp. 145-151.
H. Schrank, et al., "A Luneburg-Lens Update", Antenna Designer's Notebook, IEEE Antennas and Propagation Magazine, vol. 37, No. 1, Feb. 1995, pp. 76-79.
B. Xiang, et al., "Multi-Beam Antenna at Q Band", IEEE, 34th International Conference on Infrared , Millimeter, and Terahertz Waves, Sep. 21, 2009, 2 pages.
Ying Song Zhang et al., "A Millimeter-Wave Gain Enhanced Multi-Beam Antenna Based on a Coplanar Cylindrical Dielectric Lens", IEEE Transactions on Antennas and Propagation, IEEE Service Center, vol. 60, No. 7, Jul. 2012, pp. 3485-3488.
Extended European Search Report for EP Application No. 17169504.2, dated Aug. 25, 2017, 10 pages.
English-language Communication from EP Application No. 17169504.2, dated Jul. 27, 2018, 6 pages.

* cited by examiner

FIG. 1B
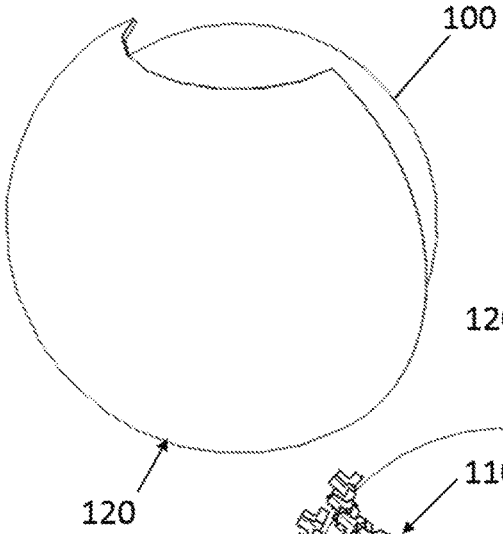
FIG. 1C
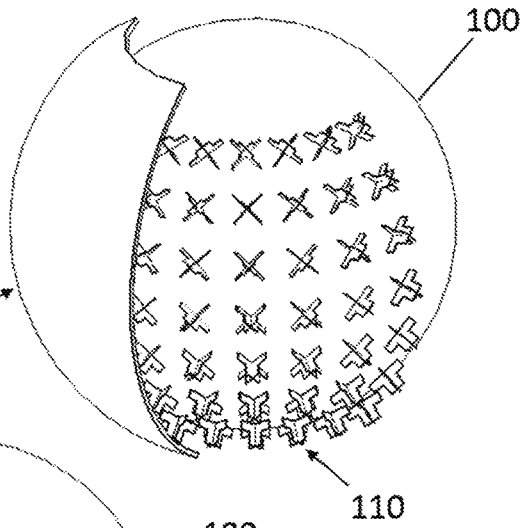
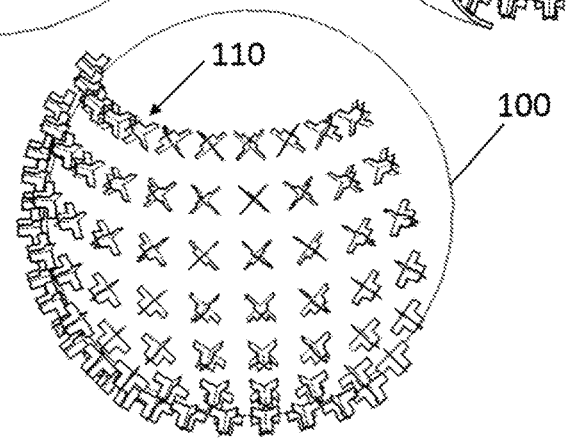
FIG. 1D

FIG. 1E
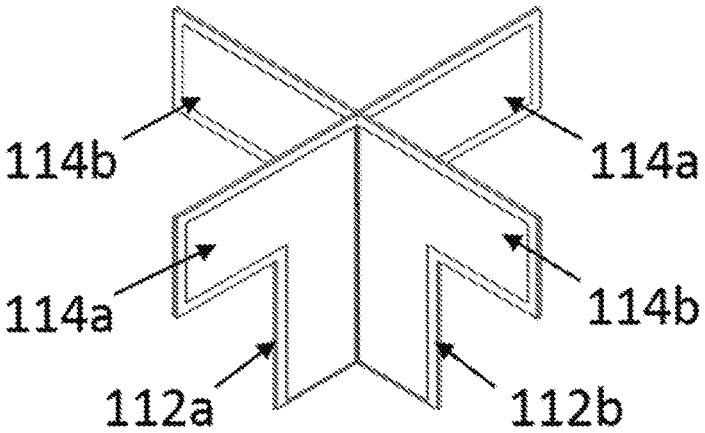
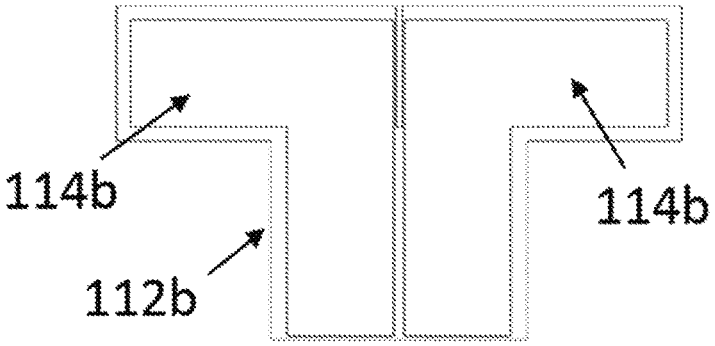
FIG. 1F

FIG. 1G
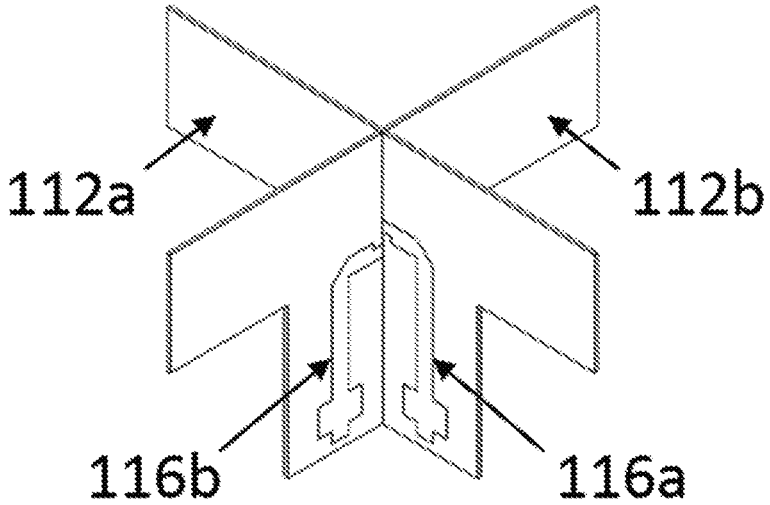
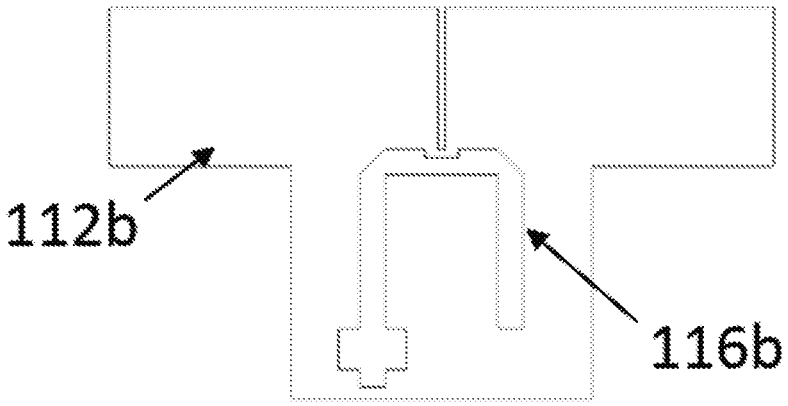
FIG. 1H

HIGH GAIN, MULTI-BEAM ANTENNA FOR 5G WIRELESS COMMUNICATIONS

RELATED APPLICATION

This application claims the benefit of U.S. Provisional Application No. 62/332,566, filed May 6, 2016, the entire contents of which are incorporated herein by reference.

BACKGROUND OF THE INVENTION

Field of the Invention

The present invention is generally related to antennas, and more specifically to lens antennas for multi-beam wireless communications systems and methods of providing such lens antennas.

Background of the Related Art

Fifth generation (5G) communications systems will provide a dramatic increase in data rates over existing technologies while allowing network access for many devices simultaneously. This will require high gain, multi-beam antennas to meet system demands for capacity and throughput. Furthermore, the high data rates anticipated for 5G encourage the use of millimeter wave frequency bands in addition to the traditional frequency bands used by earlier mobile technologies such as 4G, 3G, etc.

To meet system requirements for future 5G technologies, a large number of isolated, highly directive beams originating from a single access point are desirable. One approach to meet the demands of future 5G wireless systems with highly directional multi-beam functionality is massive MIMO antenna technology. In this approach, large antenna arrays are used with signal processing techniques to provide a narrow beam directly to the user. The antenna array is useful at providing highly directional beams to the target whereby most of the energy is focused only in the desired location.

One of the drawbacks to massive MIMO technology is the degradation in performance as the array scans to wide angles. Scan loss is observed as a gain reduction where the antenna effectively acts as a smaller aperture at wide scan angles. Scan blindness can also be a major problem for large arrays at wide scan angles where all of the energy put into the array is essentially coupled to a surface wave so that no energy radiates from the array. Furthermore, the active VSWR can be problematic and a potential cause for concern in terms of power handling.

SUMMARY OF THE INVENTION

A lens approach of the present invention, on the other hand, combines the high directivity of massive MIMO technology with the simpler architecture of traditional MIMO technology for an elegant solution free from the scanning issues present in large arrays. The spherical lens is inherently wideband enabling integrated, broadband systems with many highly directional beams. The spherical lens offers advantages over the cylindrical lens particularly in terms of capacity from a single access point. This will be a driving factor in future 5G wireless systems. Furthermore, the frequencies of interest for 5G systems enable lens sizes that open the door to affordable, high performance solutions in a reasonable package size. Similar antenna approaches have been applied for radar applications, but there is a need for this technology in future 5G wireless systems.

A high gain, multi-beam antenna system for 5G wireless communications is disclosed. The system includes a plurality of radiating antenna elements arranged along the exterior of a spherical dielectric lens. The radiating elements are arranged such that the peak of each main beam is aligned with some predetermined angle. The antenna system is intended for 5G wireless communications at frequencies of 3 GHz and above.

The dielectric lens is ideally of the Luneburg type where the dielectric constant is radially varying from $\varepsilon r=1$ at the exterior of the lens to $\varepsilon r=2$ at the center of the lens. Alternatively, the spherical lens may be constructed from a single homogeneous dielectric material for easy manufacturing at the expense of focusing ability. The lens may also be made of concentric shells of homogeneous dielectric materials improving the focusing ability while also increasing cost and complexity. The spherical dielectric lens may also be constructed by subtractive manufacturing techniques to realize a radially varying dielectric constant that closely approximates that of the Luneburg lens. This approach may offer the best focusing ability from the lens, but it is also likely to be the most labor intensive.

The radiating antenna elements may exhibit single linear, dual linear (±45°), or circular polarization where the system exhibits a minimum of 20 dB isolation between orthogonal polarizations. The radiating antenna elements are positioned along the surface of the lens such that the elements on one side of the lens do not interfere with the secondary radiation beams from the elements on the opposite side of the lens. The feed elements may or may not be arranged into rows or columns in a linear manner depending on the intended functionality of the lens. A linear element configuration where the elements are organized into rows and columns is well suited for an array configuration with beam steering capability. However, a partially linear element configuration may provide greater spherical coverage maximizing the number of fixed radiation beams for the antenna system.

The antenna elements may be set at fixed locations, or they may be moved using a positioning system to collectively alter the position of the radiating elements. The spherical lens gives a focal surface along the exterior surface of the lens so the antenna elements may be rotated around the outside of the lens without degradation of the secondary patterns.

In one exemplary embodiment, the antenna elements may be arranged in such a manner that many radiation beams are achieved that provide nearly equal beam crossover levels between all adjacent beams. Such an arrangement may be of geodesic design such that the elements are nearly equally spaced while conforming to the spherical surface of the lens.

In one exemplary embodiment, the antenna elements may be arranged such that the beam crossover levels vary depending on the relative positions of the radiating elements. For the case of linear columns of elements, the elements at the top and bottoms of the columns will have beam crossover levels that differ from the elements positioned along the equator of the spherical lens.

In one exemplary embodiment of the present invention, the antennas may be passive radiating elements with no active components included in the plurality of antenna elements.

In one exemplary embodiment of the present invention, the antenna elements may be active elements with amplitude and/or phase control. Arrays of the active elements may be used to achieve adaptive beam steering or sidelobe control.

In one exemplary embodiment of the present invention, the plurality of antenna elements may include a combination of active and passive elements. The elements may be combined for beam steering or sidelobe control.

In one exemplary embodiment of the present invention, the antenna elements may be wideband elements. In such an embodiment, the radiation beams vary in beamwidth and crossover levels across the operating band. While the element produces a gain that is either flat or monotonically increasing with frequency, a minimum beam crossover level is determined and set by the lowest frequency of operation for the radiating element. The directivity of the lens increases with frequency resulting in narrower radiation beams with increasing frequency.

In another exemplary embodiment of the present invention, the radiating antenna elements form a multiband aperture to feed the spherical lens. There may be one or more distinct radiating elements for each band of the multiband aperture. The antenna elements are interleaved to achieve multiple radiating elements per frequency band. In such case, the number of radiation beams is different per frequency band to maintain the same crossover level for the secondary radiation beams. Alternatively, the same number of secondary radiation beams may be achieved with varying crossover levels among the distinct bands of operation.

The multiband embodiment may have the low band elements or the high band elements arrayed for pattern control. By arraying the elements with a predetermined spacing, the secondary radiation beam can be manipulated to some degree. The arrays may or may not have some amount of amplitude or phase control. Arraying the high band element allows control of the secondary radiation beam such that the beamwidths of the low band elements and the high band elements may be approximately equal.

BRIEF DESCRIPTION OF THE FIGURES

FIGS. 1A-1H illustrate the present invention including the spherical dielectric lens with exemplary feed antennas positioned along the exterior surface of the lens;

DETAILED DESCRIPTION OF THE PREFERRED EMBODIMENTS

Figure 1A:
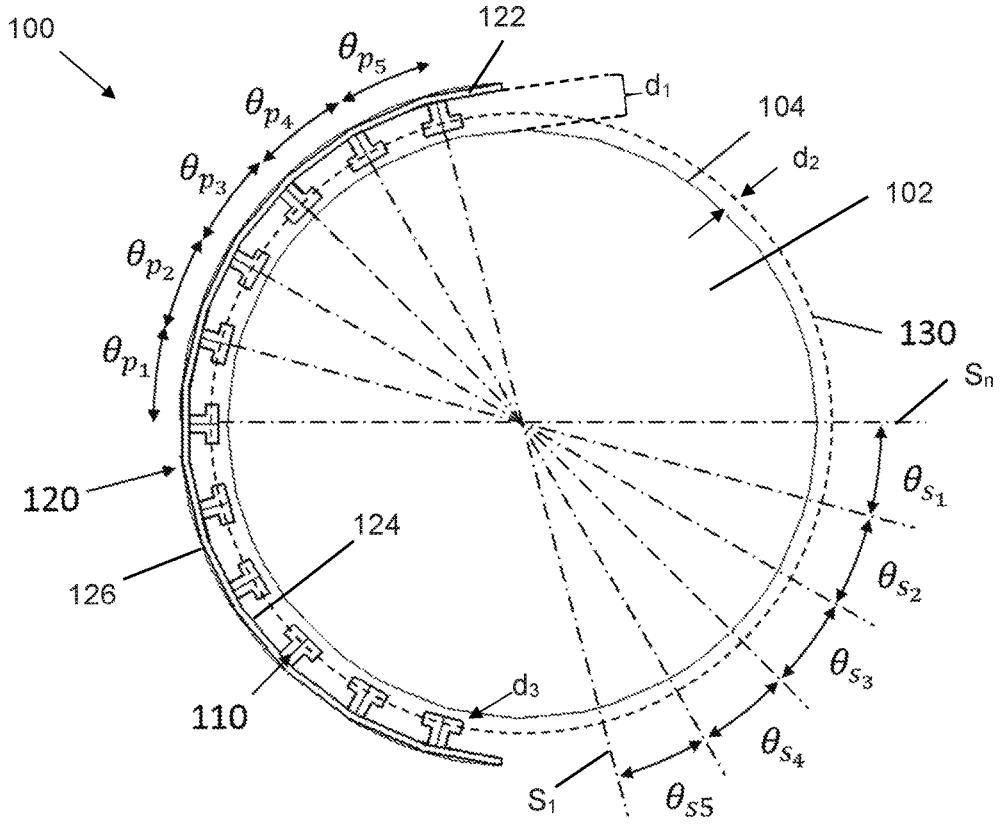

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents that operate in similar manner to accomplish a similar purpose. Several preferred embodiments of the invention are described for illustrative purposes, it being understood that the invention may be embodied in other forms not specifically shown in the drawings.

The present invention utilizes a spherical dielectric lens to provide a multi-beam, high gain antenna system for fifth generation (5G) wireless communications. The lens is ideally of the Luneburg type where the dielectric constant varies according to $\varepsilon_r=2-r^2/R^2$ where r denotes the position within lens, and R is the radius of the lens. To approximate the focusing properties of the Luneburg lens in a manner that is practical for fabrication purposes, several approaches have been presented. These include monolithic lenses where the lens is comprised of a single, homogeneous dielectric material, layered lenses where the lens is formed of spherical shells of homogeneous material, and lenses formed by additive or subtractive manufacturing methods where the lens dielectric constant is synthesized by voids formed in otherwise solid dielectric materials. The shells could be connected in any suitable manner, such as by being bonded together on their touching surfaces, or they could be bolted together with non-metallic fasteners.

With respect to FIG. 1, the spherical dielectric lens 100 is illustrated with feed antenna elements 110 positioned with the help of an element support structure 120 also providing RF ground. The lens 100 includes a spherical lens housing or body 102 that has an exterior or outer surface 104.

The support structure 120 includes a thin platform or plate 122 that is curved to be substantially parallel to and concentric with the outer surface 104 of the spherical lens body 102. The structure 120 extends along a portion of the body 102 (as best shown in FIGS. 1B-1F), and can cover for instance approximately 50% of the body 102. The platform 122 has an inner surface 124 that faces inward toward the outer surface 104 of the lens body 102, and an outer surface 126 opposite the inner surface 124. The outer surface 126 faces outward away from the outer surface 104 of the lens body 102.

As shown, the support structure 120 is a single uniform, continuous, and uninterrupted plate, which can be made of metal. One purpose of the support structure 120 is to act as a reflector/ground plane so that all energy radiated from the antenna elements is directed toward the surface of the lens. However, the support structure 120 can also be a frame formed by intersecting curved beams or a wire mesh that extend substantially parallel to and concentric with the outer surface 104 of the lens body 102 and are substantially orthogonal to each other to which the feed antenna elements 110 are connected, in a lattice-type arrangement in rows and columns. If it is a frame of intersecting beams or wire mesh, the beams must be close enough together to act as a ground plane or reflector as mentioned above.

The support structure 120 also has one or more support pillars or columns 128 (FIGS. 1I, 1J) that space the platform 122 apart from the outer lens body surface 104 so that the platform inner surface 124 is at a distance $d_1$ from the lens body outer surface 104. Each column 128 is elongated and has a first end connected to the support structure 120 and a second end (opposite the first end) connected to the lens body 102. Those connections can be made by a footing, fastener, adhesive or the like, or the columns can be integrally formed with either the platform 122 and/or the lens 100. The columns 128 extend outward from and substantially orthogonal to the inner surface 124 of the platform 122 and also outward from and substantially orthogonal to the outer surface 104 of the lens body 102. The columns 128 maintain the support structure 120 at the desired distance from the lens body outer surface 104.

Figure 1I:
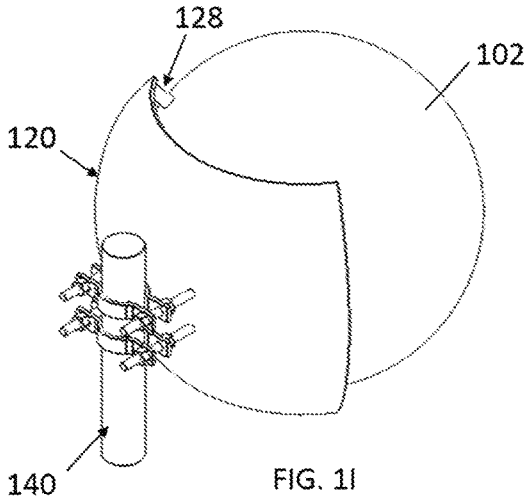
FIGS. 1I-1K are perspective views of the spherical lens mounted to a pole in accordance with the present invention.
Figure 1J:
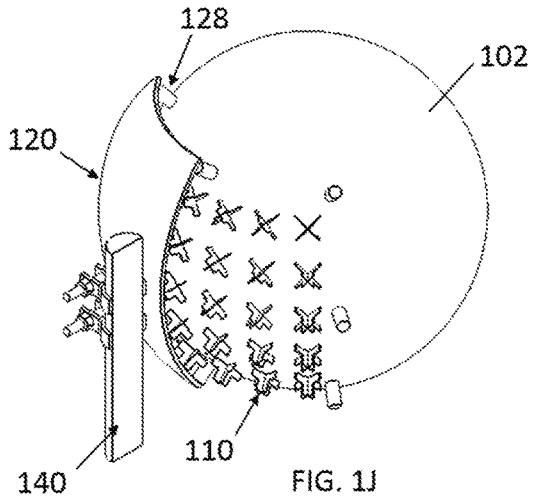
Figure 1K:
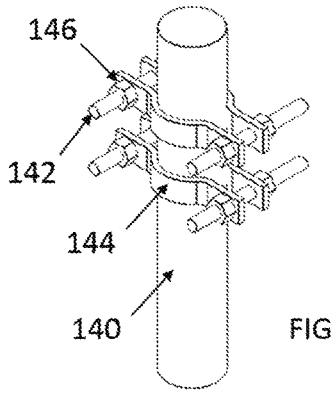

Referring to FIGS. 1I-1K for fixed tilt applications, the support structure 120 may be attached to a mounting pole 140 with mounting bolts 142, mounting brackets 144, and mounting nuts 146. The mounting bolts 142, mounting brackets 142, and mounting nuts 146 are generally made of metal such as steel or aluminum; however, they may be plastic if the weight of the lens 100 allows plastic hardware. The mounting bolts 142 are attached directly to the support structure 120 for fixed tilt applications where the support structure 120 does not move relative to the lens body 102 once installed. The mounting bolts 142 can be bolted to the support structure 120, or they can be threaded into the support structure 120 and epoxied in place. If the mounting bolts 142 are metal, they may be welded directly to the support structure 120. Four mounting brackets 144 should generally be used where there are upper brackets and lower brackets. There are preferably two mounting brackets 144 on the inside of the mounting pole 140, i.e. between the support pole 140 and the support structure 120, and two mounting brackets 144 on the outside of the support pole 140, though more or fewer can be utilized. The mounting bolts 142 pass through holes in the mounting brackets 144, and the mounting brackets 146 are secured with the mounting nuts 146.

The radiating antenna elements 110 extend outward from the inner surface 124 of the platform 122. The antenna elements 110 extend toward the lens body 102, but do not come into contact with the lens body 102. As best shown in FIGS. 1C, 1D, the antenna elements 110 are positioned equidistant from each other in a lattice-type pattern in rows and columns with respect to the lens body 102. The antenna elements 110 are coupled to the platform 122 and therefore are aligned along a curve that has a transverse axis which is parallel to and concentric with the outer surface 104 of the lens body 102.

The radiating antenna elements 110 are positioned such that the elements on one side of the lens body 102 do not interfere with the secondary radiation beams $S_1$-$S_n$ from the other elements 110, and particularly any elements 110 positioned substantially at an opposite side of the lens body 102. As shown, the secondary radiation beams are the beams after the radiation leaves the lens. Each element 110 is further positioned rotationally around the exterior surface of the lens body 102 at some angle, $\theta p_n$, relative to a neighboring element 110, resulting in a secondary radiation pattern $S_1$-$S_n$ where the main beam is centered at a corresponding angle, $\theta s_n$, relative to a neighboring secondary beam. The relative angles between the radiating elements 110 and the corresponding secondary beams $S_1$-$S_n$ are equal such that $\theta p_n = \theta s_n$.

The lens 100 may be constructed by any number of methods mentioned above, but one preferred embodiment utilizes the layered lens constructed of concentric shells of dielectric material. The materials comprising the lens have substantially homogeneous dielectric constant values generally in the range of $\varepsilon_r$=1-3.5 with low dielectric loss tangents. The size of the lens 100 is generally determined by the desired antenna gain, and should be a minimum of approximately 1.5 wavelengths in diameter. Little gain is achieved for lenses with diameters smaller than 1.5λ, and the performance enhancement of the lens may not justify the cost and complexity added to the system. The antenna elements 110 are generally positioned along the focal surface 130 of the spherical lens. One of the benefits of the spherical lens is the spherically symmetric focal surface allowing many radiating antenna elements 110 to be placed around the exterior surface of the lens 100 with theoretically no performance degradation assuming all elements 110 correspond to the established focal surface. Future 5G systems look to utilize millimeter wave bands in order to provide the desired data rates. As a result, the spherical lens can be several wavelengths in diameter to provide highly directive radiation beams while occupying a physically small volume. This opens the door to practically realizable lens-based, multi-beam systems at an affordable cost.

The element support structure 120 is composed of metal with a substantially high electrical conductivity such as aluminum or copper. The structure serves to provide mechanical support for the antenna elements 110 and associated feed network(s) along with RF ground for the system. The positioning of the elements 110 relative to the lens 100 is generally dictated by the element support structure 120 where the elements 110 are positioned such that they do not make physical contact with the lens 100. The space between the elements 110 and the exterior surface of the lens 100 generally has an impact on the aperture efficiency of the lens. The focal surface 130 of the ideal Luneburg lens generally lies on the exterior surface of the lens.

However, practical realization of the spherical lens due to the feed element pattern and the materials of the lens may create an optimal focal surface 130 that is some distance $d_2$ from the exterior surface 104 of the lens 100. Therefore, care should be taken to determine the distance $d_3$ between the radiating elements 110 and the outer lens surface 104 for optimal system performance.

The distance d2 can be larger than d3, smaller than d3, or it can equal d3. Typically, the phase center of the antenna should correspond with the focal surface of the lens. Different antenna types exhibit different phase centers, so the distance d3 will change depending on the type of antenna used to feed the lens. The distance $d_1$ must be larger than $d_2$ and $d_3$ to ensure that the antenna element 110 does not contact the outer lens surface 104. It is important to determine this distance $d_3$ prior to final system fabrication and assembly and even before the design of the element support structure 120.

The support structure 120 provides RF ground for the feed structure used to provide signal to the elements 110 and for the elements 110 themselves. This RF ground structure 120 also acts a reflector so that the energy radiated from the elements 110 is directed toward the surface of the lens and not away from the lens. Without the structure 120, the elements would radiate in a more omnidirectional fashion, which is not desirable for lens antennas.

For purposes of illustrating the present invention, FIG. 1B illustrates the antenna system with the full element support structure 120, FIG. 1C shows half of the element support structure 120 cut away to show the elements 110 between the element support structure 120 and the lens 100, and FIG. 1C shows the elements 110 without the element support structure 120. The structure 120 may vary in size and shape depending on the antenna element 110, the element arrangement, and the corresponding feed method as those skilled in the art can appreciate. For example, antenna elements 110 fed by microstrip traces have corresponding printed circuit boards bonded to the structure 120. For waveguide antenna elements, this structure merely serves as an element support structure for the individual antenna elements.

The antenna elements 110 shown in FIG. 1, and all other figures, are shown as crossed dipole elements. FIGS. 1E-1H illustrate detail drawings of the elements 110. In one illustrative non-limiting embodiment, the elements 110 are fabricated from double sided printed circuit board (PCB) material where the +45° dipole PCB material 112*a* is positioned substantially orthogonal (90°) with respect to the −45° dipole PCB material 112*b*. Thus as best shown in FIG. 1F, the first portion 112 extends substantially orthogonal to the second portion 114 to form a general T-shape. The first portion 112 is coupled with and extends substantially orthogonal to the inner platform surface 124. The second portion 114 is coupled with the first portion 112 and extends substantially parallel to and spaced apart from both the inner platform surface 120 and the outer lens body surface 104. The focal surface 130 is aligned with the phase center of the element feeding the lens. As shown, the focal surface 130 can be aligned with the middle of the second portion 114, though need not be aligned with the middle of the second portion 114.

The particular PCB material may be chosen from a plethora of available materials, but the material is generally chosen to have a dielectric constant value in the range of $\varepsilon_r$=2-5 with a low dielectric loss tangent. For example, a suitable material would be Arlon 25N with a dielectric constant $\varepsilon_r \approx 3.38$ and a loss tangent tan $\delta \approx 0.0025$. The dipole arms 114*a*/114*b* shown in FIGS. 1E, 1F, as well as the baluns 116*a*/116*b* shown in FIGS. 1G, 1H, are generally copper and can be formed by etching or milling away the copper cladding from the PCB material. The dipole arms 114*a*/114*b* form the radiating structures for the antenna while the baluns 116*a*/116*b* provide a transition from the feed network generating the proper phase on each dipole arm as those skilled in the art can appreciate. Any suitable structure and arrangement for the baluns 116 can be utilized.

The elements 110 are generally fixed to the inner surface 124 of the element support structure 120 by way of epoxy or solder. The elements 110 should generally be in electrical contact with the element support structure platform 122. The elements may be bonded directly to the element support structure platform 122 using solder or conductive epoxy where the lower portion of each dipole arm 114*a*/114*b* is in direct contact with the element support structure 120. The lower portion of the dipole arm refers to the metallization of each dipole arm 114*a*/114*b* that is nearest to the housing structure. The upper portion of each dipole arm 114*a*/114*b* constitutes the primary radiating region of the dipole. In an alternative approach, the feed network(s) for the elements 110 may be bonded to the support structure using conductive epoxy or solder, and the elements may be fixed to the feed network using conductive epoxy or solder. The elements 110 may also be bonded to the support structure using non-conductive epoxy and fed by coaxial cables. In this feeding approach, the outer shielding of the cables should be bonded to the element support structure in some way either mechanically or with conductive epoxy or solder. The dipole arms 114*a*/114*b* should also be connected to RF ground, such as being directly soldered to RF ground.

It is stressed, however, that the present invention is not limited to dipole elements, but rather any suitable structure can be utilized. Crossed dipoles are used in many mobile base station antennas to provide orthogonal, dual linear polarization for polarization diversity. The lens may be fed by any style of radiating antenna element such as the patch antenna, open-ended waveguide antenna, horn antenna, etc. Generally, low gain antennas are selected as feed elements for the spherical lens in order to maximize the lens efficiency and the directivity of the secondary radiation beam. The present invention is also capable of operating with multiple polarizations thanks to the spherically symmetric nature of the dielectric lens. The radiating antenna elements may exhibit single linear, dual linear, or circular polarization. Multiple polarizations may be important for future 5G systems where polarization selection may be different depending on the operating frequency and the intended user. Therefore, the multi-beam antenna should perform sufficiently no matter the desired polarization with a minimum of 20 dB isolation between orthogonal polarizations. No matter the particular feeding approach or element selection, the element support structure 120 serves to position the elements 110 relative to the lens 100 and should generally be connected to RF ground, such as by solder, conductive epoxy/adhesive, or capacitively coupled.

The maximum gain and beamwidth for the spherical lens may be approximated by assuming the lens to be a circular aperture. The normalized far-field pattern for an ideal circular aperture is given analytically in terms of θ as:

$$G(\theta) = 2\frac{J_1(ka\sin(\theta))}{ka\sin(\theta)}$$

where $J_1$ is the Bessel function of the first kind of order 1. The argument of the Bessel function is ka sin(θ) where k is the wavenumber, a is the radius of the aperture (or sphere in this case), and θ is the angle off boresight measured from the z-axis. The above equation gives a normalized pattern shape by which the main beam pattern is well approximated. Therefore, the lens can be approximately sized according to the far-field approximation for the circular aperture. As an example, a lens approximately 4.2" in diameter is required to achieve a −10 dB crossover level for antenna elements spaced 10° apart around the lens equator operating at 28 GHz using the far-field pattern for a circular aperture.

Figure 2A:
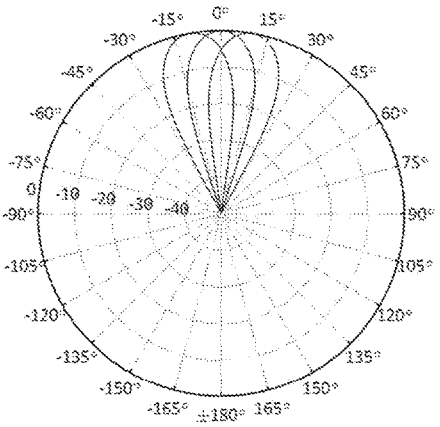
FIGS. 2A-2D show notional secondary radiation beams at two frequencies for various lens sizes with predetermined element spacing.
Figure 2B:
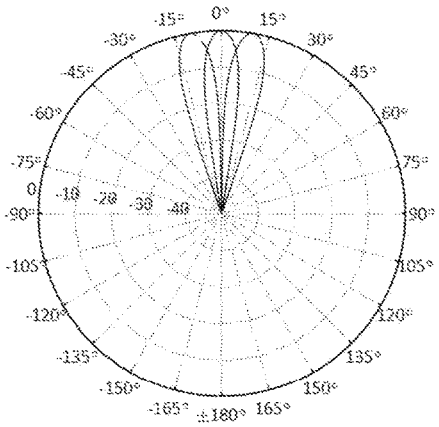
Figure 2C:
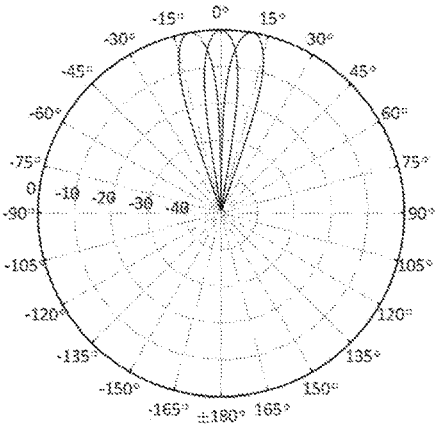
Figure 2D:
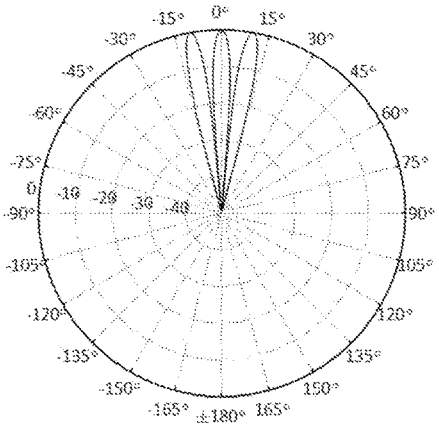

In FIGS. 2A-2D, the circular aperture approximation is applied to illustrate the notional secondary radiation beams where the normalized patterns are shown in dB units. All antenna feed elements 110 are positioned approximately 10° apart around the equator of the spherical lens for FIGS. 2A-2D. The notional secondary radiation beams for a 3" spherical lens at 15 GHz and at 30 GHz are shown in FIGS. 2A and 2B, respectively. The notional secondary radiation beams for a 6" spherical lens at 15 GHz and at 30 GHz are shown in FIGS. 2C and 2D, respectively. The patterns illustrate the performance of the normalized main beam radiation with all sidelobes removed at an assumed lens efficiency of 100% for illustration purposes. As a result, the theoretical minimum achievable beamwidths are shown.

Generally, Luneburg lens efficiencies are in the range of 50-75% meaning a decrease in the gain and directivity for the realizable system resulting in wider secondary radiation beams. The realized efficiency is generally determined and optimized by a combination of experimental investigation and full-wave analysis. The plots of FIG. 2 illustrate the notional system performance based on frequency and lens diameter. The secondary beam crossover levels are significantly different between FIGS. 2C and 2D clearly demonstrating that for a broadband solution, more radiation beams are achievable at higher frequencies due to the larger electrical size of the spherical lens.

Gain and beam crossover are of prime importance for 5G systems where high capacity and high data rates drive research and development. As indicated in FIG. 2, the performance of the lens is directly related to frequency, or electrical size. For example, a 4" diameter lens may provide the directivity sufficient for an application at 30 GHz, but a lens 8" in diameter would be needed to achieve the same directivity at 15 GHz. Fifth generation is an emerging technology open to many applications at various frequencies, and as a result, the lens is sized appropriately based on the intended 5G application. A lens antenna system that works well for one 5G application may not necessarily be the optimal solution for another 5G application.

Figure 3A:
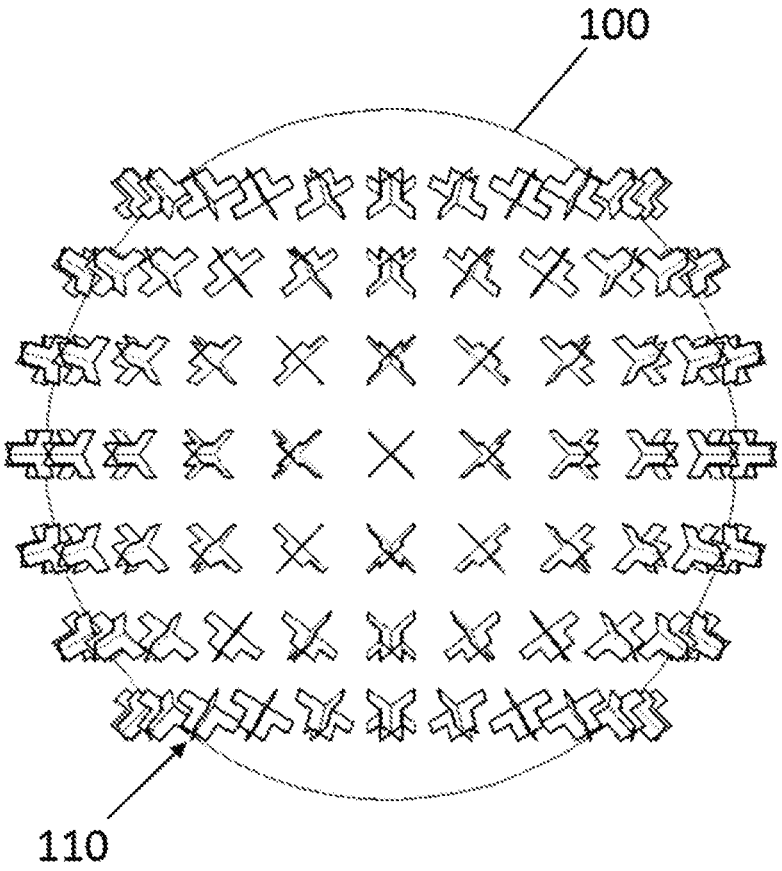
FIGS. 3A-3B illustrate the plurality of feed antennas configured into linear rows or columns arranged around a portion of the spherical lens.
Figure 3B:
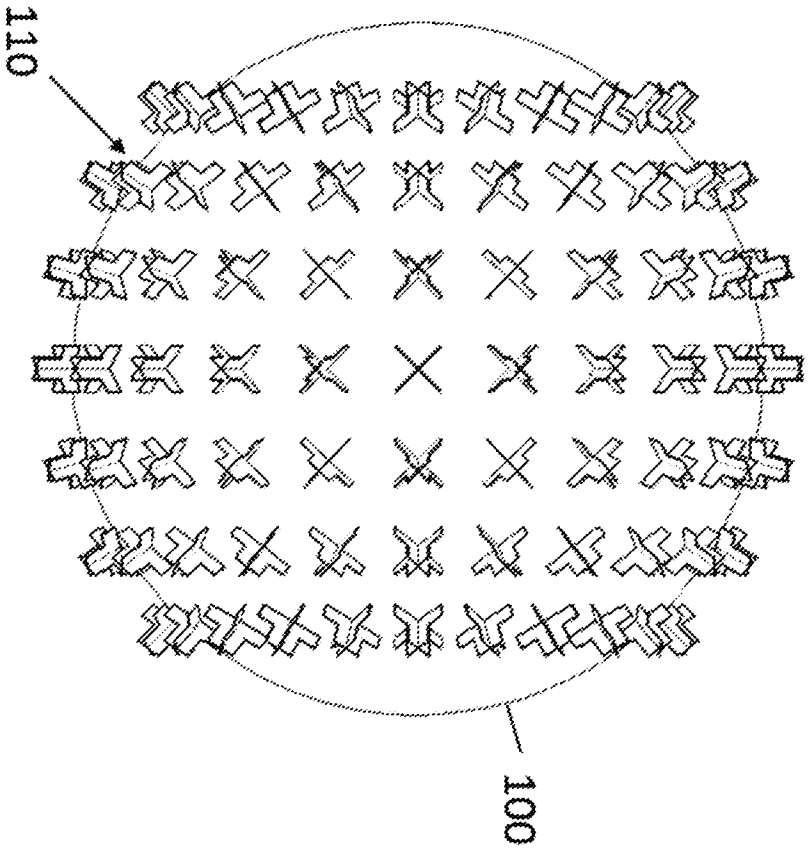

The plurality of antenna elements 110 may be arranged in a linear fashion according to FIG. 3. For the linear feed arrangement, the feed configuration is defined in matrix form, and the total number of feed elements is written as $$F_T = M \times N$$

where $F_T$ indicates the total number of antenna elements 110 feeding the lens, M indicates the number of elements in each row (azimuth direction), and N indicates the total number of elements in each column (elevation direction). The elements may be arranged where M<N as indicated by FIG. 3A, where M>N as indicated by FIG. 3B, or where M=N.

The linear antenna arrangement is well suited for arrays of radiating elements feeding the lens, but this arrangement suffers from non-uniform element spacing when the plurality of radiating elements cover a significant portion of the lens. According to FIG. 3, the antennas near the edges of the plurality of elements are at a different spacing than the central elements. The result is non-uniform beam crossover between adjacent radiation beams for the spatial coverage area. For this element arrangement, a desired minimum beam crossover level is set by the edge elements where the plurality of remaining elements will certainly meet the minimum crossover requirements. However, this is predicated on the assumption that the same radiating elements are used for the entire plurality of radiating elements. Otherwise, the beam crossover levels may vary across the plurality of radiating elements based on the primary radiation patterns and illumination efficiency for the lens.

To overcome the issue of non-uniform beam crossover for the linear arrangement of radiating elements, different element types may be used. For example, dipole antennas may be used for the outer elements where patch antennas may be used for the central elements. Different antenna types result in different primary radiation patterns with different illumination efficiencies for the lens. The result is a different gain and beamwidth between the two antenna types. Therefore, the linear antenna element arrangement may still be utilized with the same, or nearly the same, beam crossover due to the different element types.

The linear arrangement of the plurality of antenna elements may be combined to form an array with beam steering capabilities as shown in FIG. 4. The antenna elements may be combined in azimuth 400, elevation 410, or both 420. The result is a fewer number of radiation beams; however, some or all of the beams may have steering capability or sidelobe control.

Figure 4A:
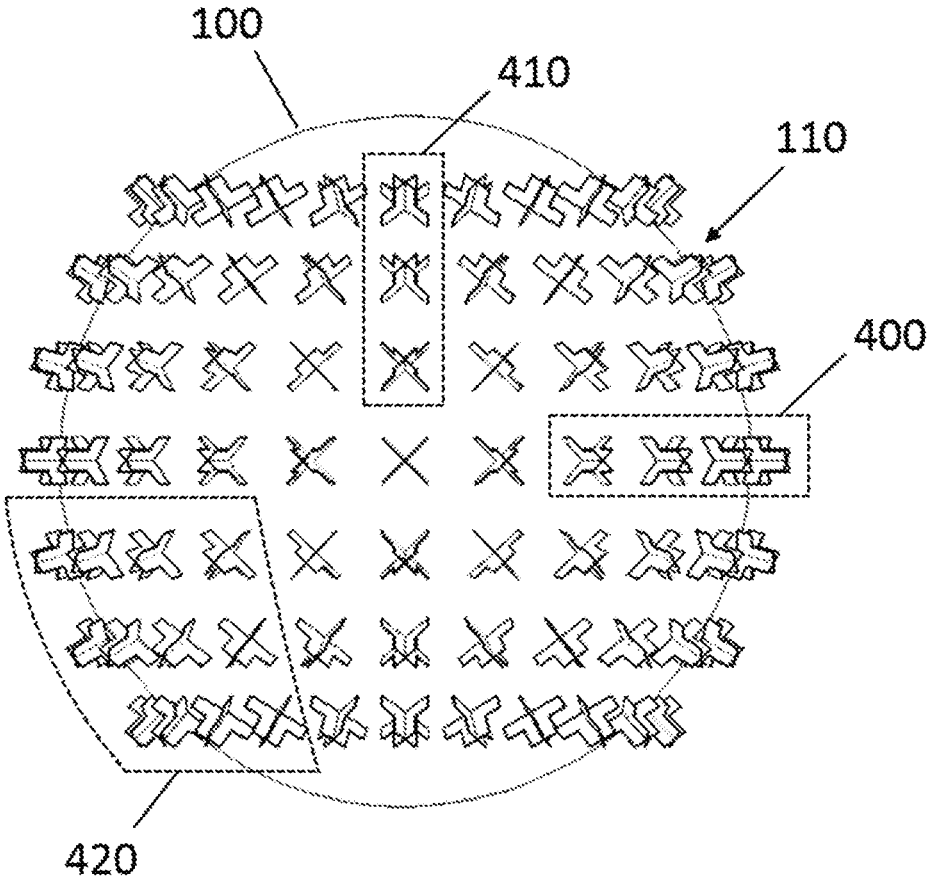
FIGS. 4A-4B illustrate the linear antenna arrangement combined to form a linear array for electronic beam steering along with a conceptual block diagram.
Figure 4B:
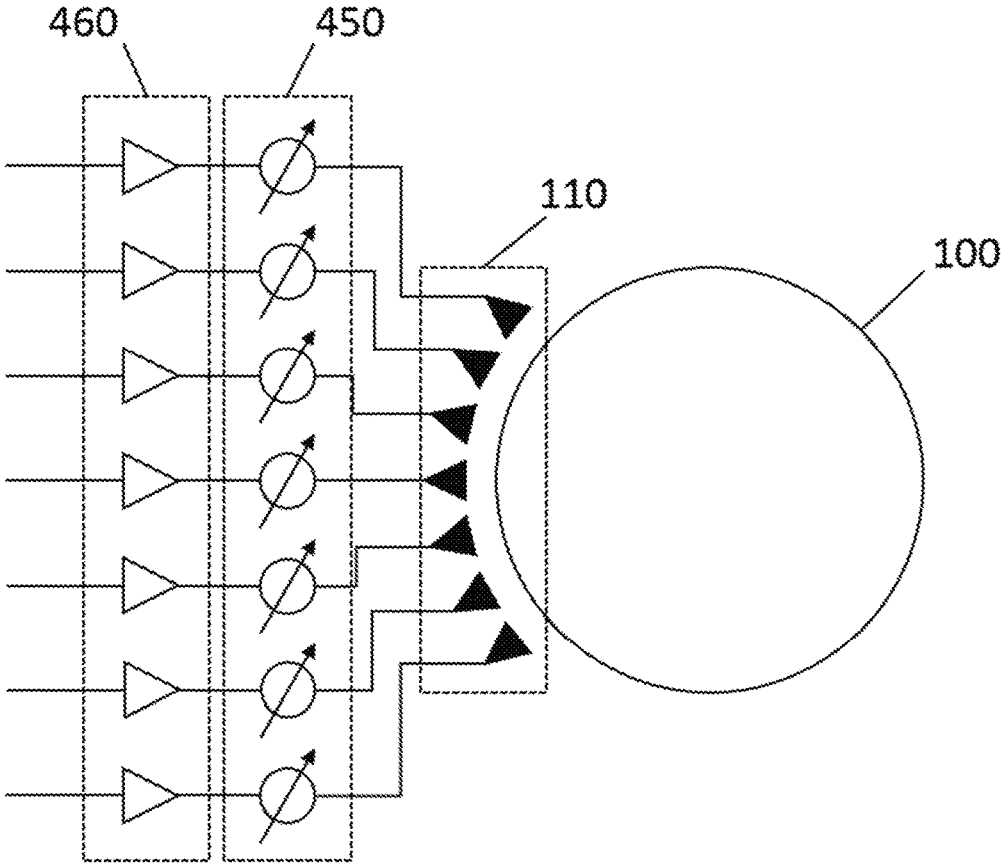

A conceptual block diagram for the array is shown in FIG. 4B. The system is comprised of the spherical lens 100, antenna elements 110, phase shifters 450, and amplifiers 460. As shown, the element array 110 is couple with a phase shift array 450, which in turn is connected with an amplifier array 460. In one embodiment, each element 110 is connected with a respective phase shifter 450, which in turn is connected with a respective amplifier 460. There may be more or fewer amplifiers 460 compared to the number shown. The phase shifting 450 for the linear array may be accomplished by any number of methods, or the array may be frequency scanned as an alternative. There may be more or fewer phase shifters 450 than the number shown. The active components should be included in close proximity to the radiating elements 110 for optimal performance. If the elements are combined in both azimuth and elevation, many elements may be combined in one axis, but only a few elements should be combined in the orthogonal axis. The reason is that as the gain of the antenna feeding the lens increases, the efficiency of the lens decreases. Therefore, an array of many elements combined in multiple axes would essentially nullify the added benefit of a lens making the approach an impractical solution.

Figure 5A:
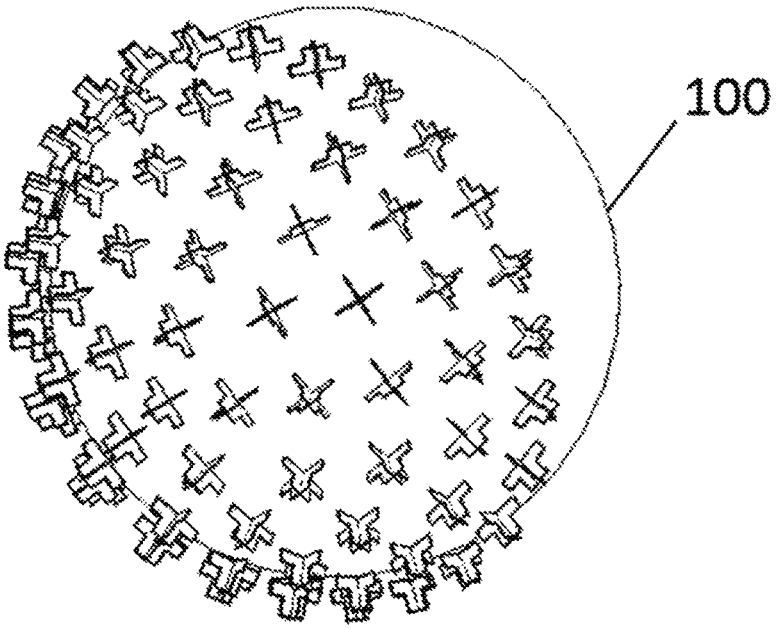
FIGS. 5A-5B illustrate the plurality of feed antennas configured in a partially linear arrangement around a portion of the spherical lens.
Figure 5B:
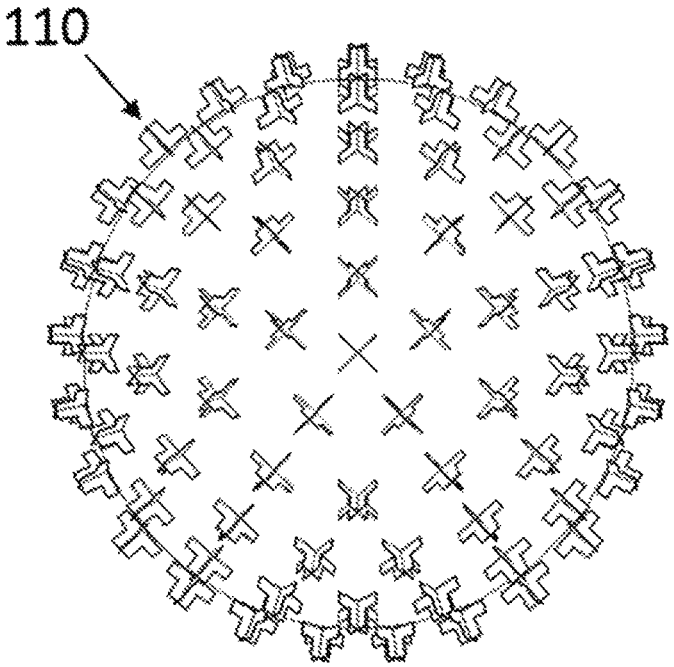

For enhanced spherical coverage, the antenna elements may be arranged in a partially linear, or non-linear manner according to FIGS. 5A, 5B. Here, the elements 500 are arranged in a geodesic fashion such that they maintain a fairly regular spacing between adjacent elements with a deterministic positioning scheme. This element arrangement is particularly beneficial for maximizing spatial coverage while maintaining a specified crossover level between adjacent secondary radiation beams. There is minimum deviation in the beam crossover for the plurality of secondary beams and improved spatial coverage compared to the strictly linear element arrangement. Fifth generation wireless systems will look to maximize spatial coverage while providing the highest possible data rates with minimal interference. The elements are arranged linearly along longitudinal axes from the top to the bottom to all converge at the top and bottom poles. The partially linear element configuration allows maximum spatial coverage with a nearly uniform beam crossover level for optimal system performance making this approach ideally suited for 5G small cells in congested areas. As with the strictly linear arrangement, the non-linear arrangement of elements may also include antennas of different types.

A subset of the plurality of antenna elements arranged in a partially linear fashion may also be combined to form an array with beam steering capabilities. Like the strictly linear array, this results in a reduced number of radiation beams, but the resulting beams have electronic steering capabilities. This approach is not shown in a separate drawing as it is similar in design and functionality to the linear array. The only difference between the two is the manner in which the elements are combined.

Figure 6A:
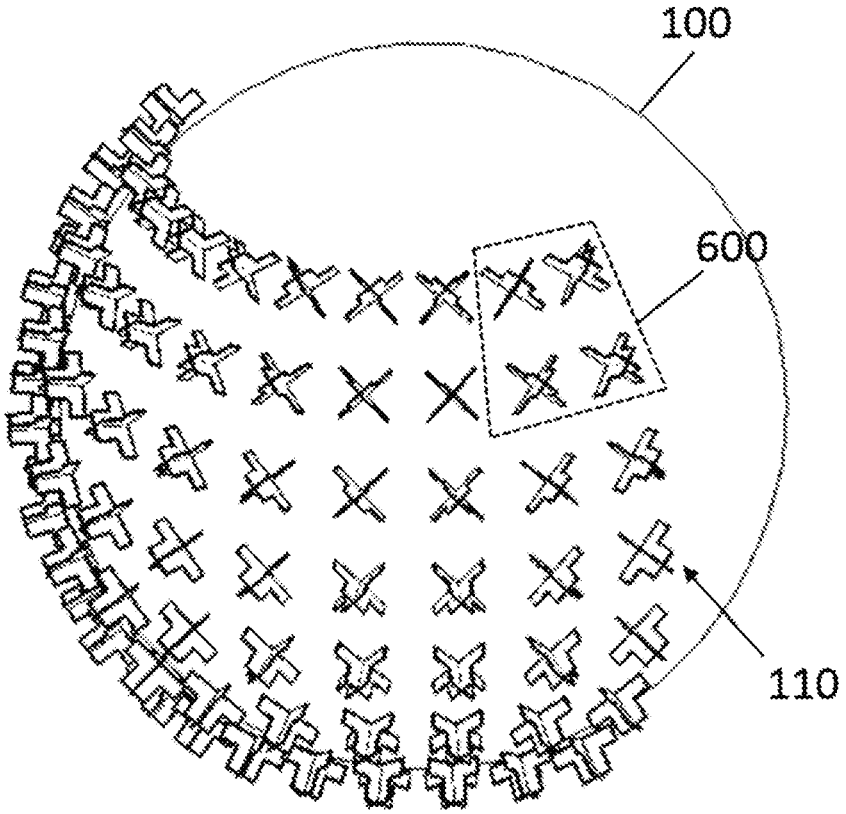
FIGS. 6A-6B illustrates a portion of the plurality of antenna elements arrayed for secondary beam control along with the notional secondary beam patterns.

With respect to FIG. 6A, a small subset of the plurality of radiating elements may be combined to form an array 600 for control of the secondary radiation beam. As mentioned previously, the characteristics of the secondary radiation beam are partially dependent on the characteristics of the primary radiation beam. Narrower beams from the primary source tend to under-illuminate the lens resulting in a reduced lens efficiency. Generally, antenna elements may be combined to give more gain and a narrower main beam compared to a single source antenna.

Figure 6B:
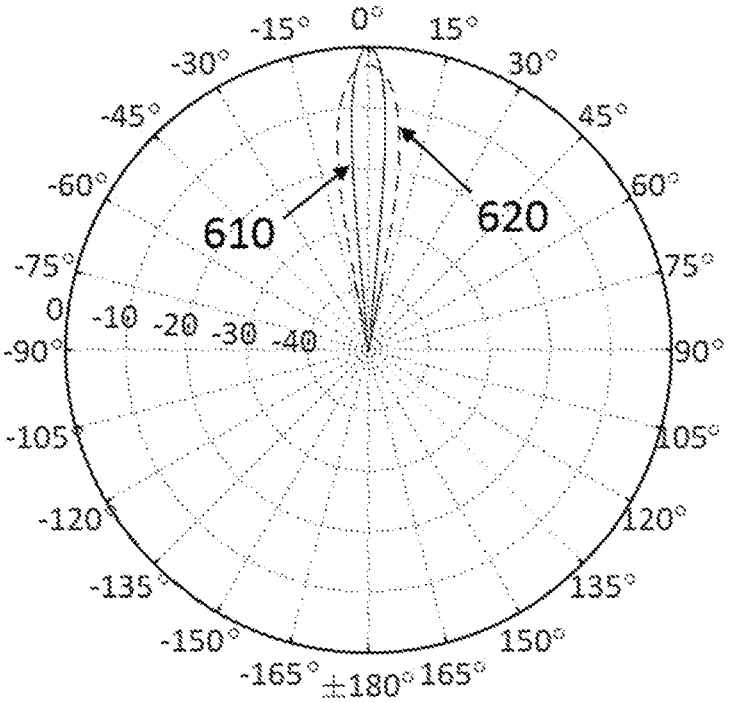

Therefore, antenna elements may be combined to modify the gain and beamwidth of the secondary radiation beam from the spherical lens. FIG. 6B illustrates notional main beam radiation patterns expressed in dB for the array concept. The secondary main beam from the single source 610 will generally exhibit more gain and a narrower beamwidth compared to the secondary main beam from the array 620. Both beams are normalized to the maximum gain for the single source to illustrate the resulting gain reduction.

The positioning of the elements to modify the secondary beam can be roughly determined by the blur spot of the spherical lens. As shown in U.S. Pat. No. 8,854,257, which is hereby incorporated by reference, the blur spot is approximated by:

$$d_b = 1.22f\frac{\lambda}{D}$$

where f is the focal length of the lens, λ is the free-space wavelength, and D is the diameter of the lens.

To effectively increase the beamwidth of the secondary radiation beam, the combined elements should be positioned within the blur spot but near its edges. If the elements are too close together, the secondary radiation beam appears to be from a single source, and the resulting directivity is nearly the same as that of a single source. If the elements are positioned too far apart and fall outside of the blur spot, multiple peaks may be present in the secondary radiation beam. Therefore, care should be taken in the antenna placement to achieve the desired gain reduction while maintaining the appropriate beam shape. This approach may be particularly useful for the multiband case where the distinct frequency bands are close together, and it is desired that the distinct radiation beams are of approximately the same beamwidth.

For the case where broadband radiating elements are used, the radiation beams will have a varying beam crossover throughout the band of operation. The antenna elements should be arranged such that there is no more than a single element within the blur spot of the lens at any given frequency to maintain desired performance. The minimum element spacing is generally determined by the beamwidth of the antenna at the lowest frequency of operation assuming the pattern of the primary source does not vary significantly over the operating band and generally shows a slowly-varying, monotonic increase in gain over frequency. For broadband elements exhibiting significant gain variation over the range of operation, care should be exercised to ensure proper element spacing to achieve desired beam crossover for adequate system performance as those skilled in the art can appreciate.

Figure 7A:
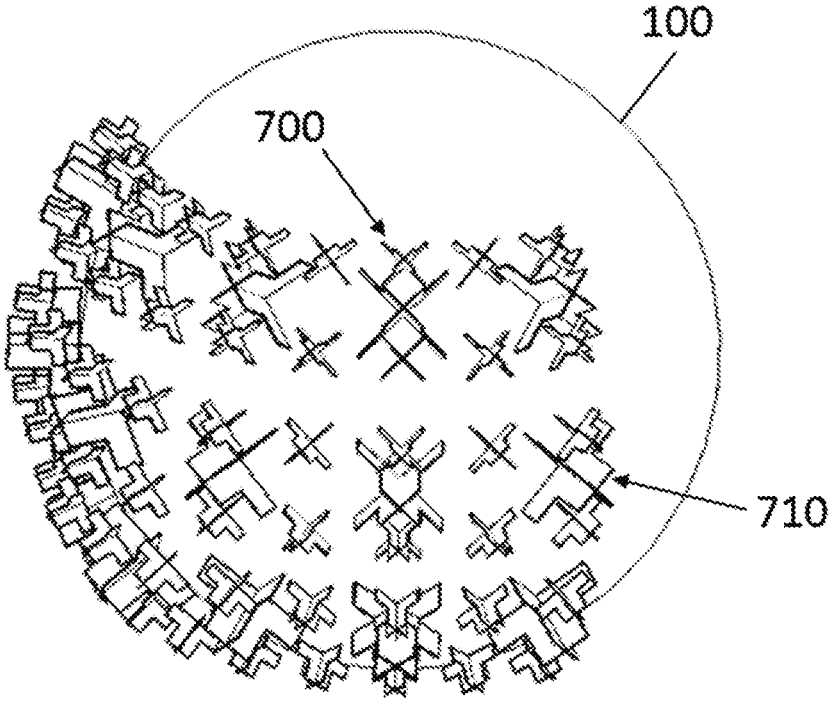
FIGS. 7A-7B show a typical multiband arrangement where the antenna elements for distinct frequency bands are interleaved along with notional secondary radiation beams.
Figure 7B:
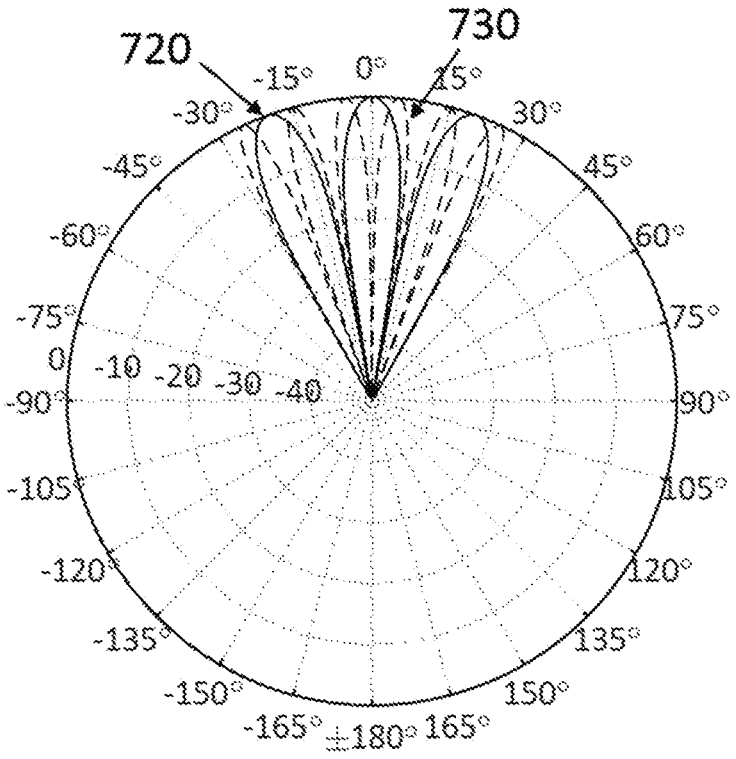
Figure 8A:
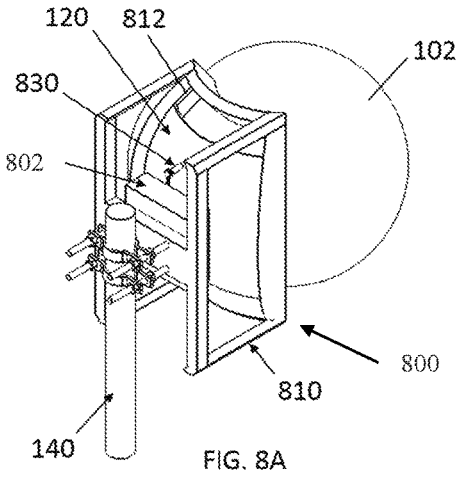
FIGS. 8A-8F illustrate the mechanical positioning system to adjust secondary beam positions.
Figure 8B:
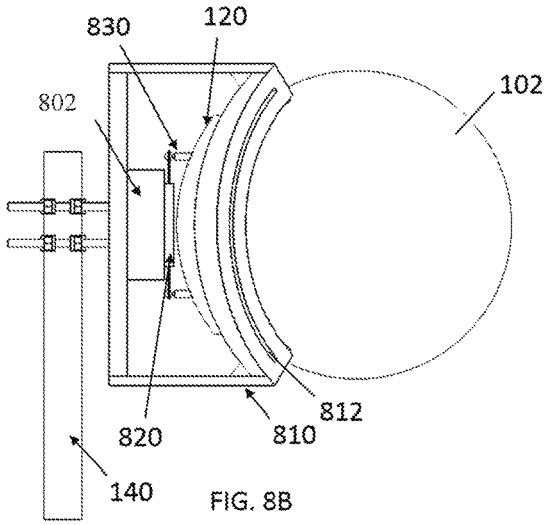
Figure 8C:
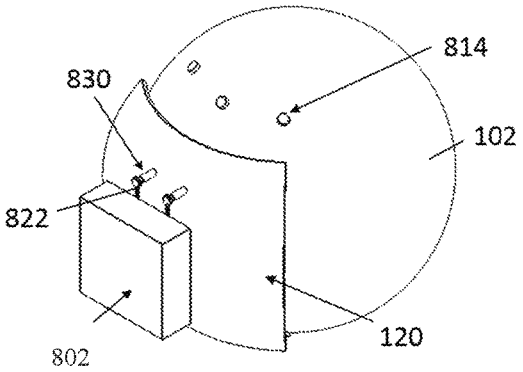
Figure 8D:
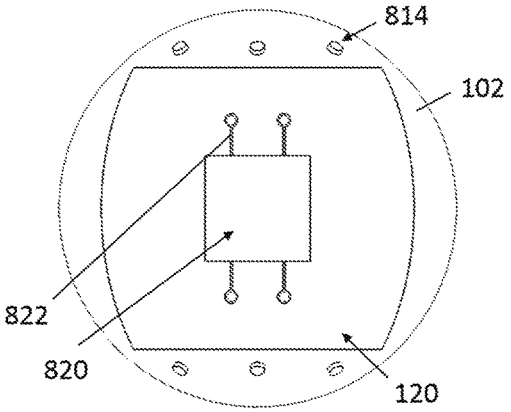
Figure 8E:
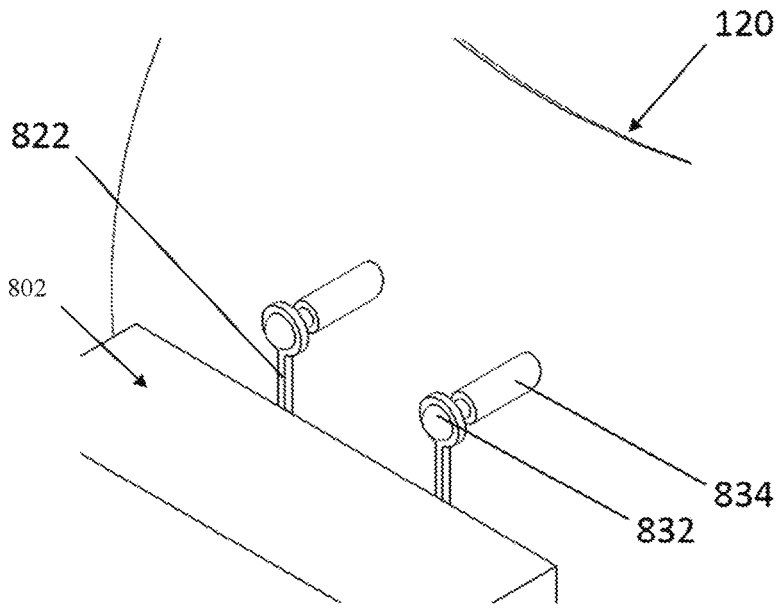
Figure 8F:
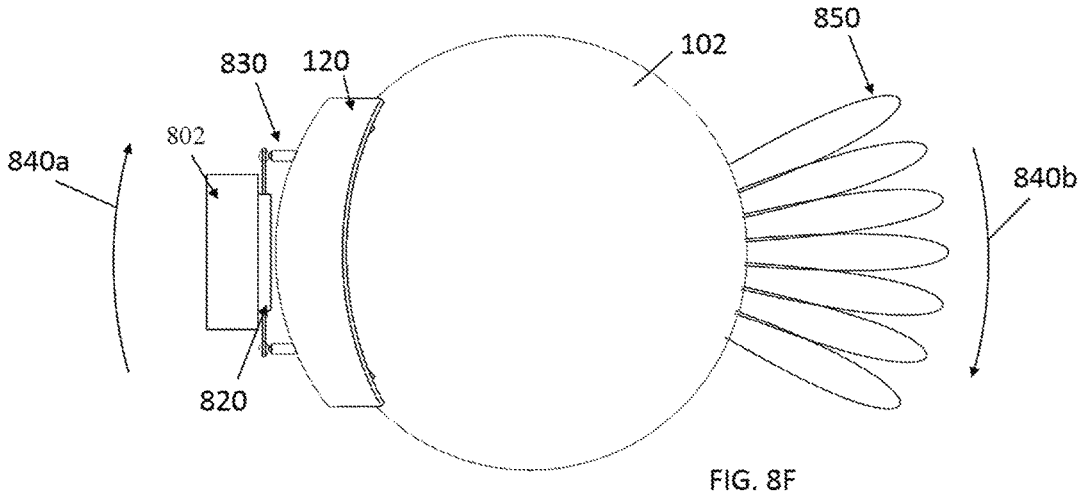

With respect to FIG. 7, the present invention may be configured to operate in two or more distinct frequency bands where distinct antenna elements may be used. For the dual-band case shown in FIG. 7A, the antenna may be configured with low band (band 1) elements 700 and high band (band 2) elements 710. The elements are ideally interleaved such that the secondary beams for band 1 significantly overlap the secondary beams for band 2. The resulting notional secondary radiation beams expressed in normalized dB are shown in FIG. 7B where the band 1 beams 720 overlap the band 2 beams 730. In order to reduce the difference in the secondary beamwidths for the distinct operating bands, the elements may be combined as discussed previously taking into consideration the dimensions of the blur spot for the frequency band of interest. This approach is generally not applicable to reduce the beamwidth of the lower band secondary beams where the limiting factor is the physics responsible for the operation of the lens. The secondary radiation beams for higher bands of operation, on the other hand, may be modified to more closely match those for lower bands of operation. This will reduce the number of beams possible for higher bands of operation, but the crossover levels between distinct bands may be similar. The elements 700, 710 can be formed in a pattern depending on the relationship between the operating frequencies of the two elements and the desired beam crossover in each band.

If the elements 110 are not combined to form some type of array, the pattern of elements 110 is chosen to maintain a certain overlap between secondary radiation beams $S_1$-$S_n$. For example, spacing the elements 10 degrees apart will correspondingly space the center of their secondary radiation beams 10 degrees apart. If the elements 110 are combined to form some type of array, the element spacing can be chosen to enable array performance as well as maintain beam overlap between secondary beams formed by neighboring arrays. For antenna arrays, the spacing is generally chosen to avoid the presence of grating lobes. So if the elements 110 are combined to form arrays, their spacing should avoid grating lobes. If the elements 110 are only combined to control the secondary beamwidth as shown in FIG. 6, the element spacing can be adjusted to adjust the secondary beamwidth. The number of radiation beams required determines the number of elements used for the lens. If none of the elements 110 are combined and 20 radiation beams are needed by the system, then 20 elements are used to feed the lens. Furthermore, the elements 110 should be positioned such that they do not "see" other elements 110 feeding the lens. The antenna is meant to provide a communication link to 5G devices (cell phones, tablets, PCs, etc.) so the feed elements should be arranged in such a way that any element does not interfere with the secondary radiation beam of any other element.

To recap, FIG. 1A shows the principle of operation of the lens antenna. Without the lens, the feed elements radiate a broad radiation pattern. By putting a lens in front of the elements, the radiation pattern is transformed into something more narrow. For example, FIGS. 2A-2D show the radiation pattern from a single element would be broader than that shown in FIG. 2A. By placing the lens in front of the elements, the pattern can be transformed into that of FIG. 2A, 2B, 2C, or 2D where the lens size determines how narrow the beam is. It requires a larger lens to achieve the patterns of FIG. 2B than it does to achieve the patterns of FIG. 2A. The angles (θ) in FIG. 1A show that you get the same angular spacing between radiation beams as what you set for the feed elements. If there is an angular spacing of 10 degrees between the feed elements, then you will have 10 degrees between the center of the radiation beam from the lens. FIG. 1A also demonstrates that you can use the lens to achieve multiple beams by using multiple feed elements 110. FIGS. 1B-1D show a 3D version of FIG. 1A, and FIGS. 1F-1H show the feed elements of an example embodiment. FIGS. 2A-2D show the narrowing of the radiation beams with increasing lens size.

FIG. 3A shows an element arrangement where the elements are configured in rows. In this configuration, the elements are uniformly spaced vertically and non-uniformly spaced horizontally. This configuration would be used when it is more desirable to maintain a constant beam overlap in the vertical direction, but it is less important in the horizontal direction. This could also be useful to provide electronic beam steering in the horizontal direction. The elements could be combined in linear arrays where the phase and amplitude between elements is used to steer the beam and provide some beam shaping in the horizontal direction without having to physically move the antenna.

FIG. 3B shows basically the opposite of FIG. 3A where the elements are configured in columns. In this configuration, the elements are uniformly spaced horizontally and non-uniformly spaced vertically. This configuration would be used when it is more desirable to maintain a constant beam overlap in the horizontal direction, but it is less important in the vertical direction. This could also be useful to provide electronic beam steering in the vertical direction. The elements could be combined in linear arrays where the phase and amplitude between elements is used to steer the beam and provide some beam shaping in the vertical direction without having to physically move the antenna.

FIG. 4A illustrates some of the concepts where 410 shows a group of elements that could be used to provide beam steering in the vertical direction and 400 shows a group of elements that could be used to provide beam steering in the horizontal direction. 420 illustrates an element grouping that could be used to provide beamforming in either the horizontal direction, the vertical direction, or a combination of both. The block diagram in FIG. 4B illustrates one that might be used to create a steerable linear array with the lens. The amplifiers 460 can be used to control the amplitudes of the feed elements 110, and the phase shifters 450 can be used to control the relative phases between the elements which provides the ability to steer the beam.

FIGS. 5A-5B show a geodesic arrangement of feed elements. This approach maintains a more uniform angular element spacing around the surface of the lens. As a result, a more uniform beam overlap can be obtained for the beams radiated from the lens.

FIG. 6 illustrates the concept of combining elements to control the beamwidth of the beam radiated form the lens. By combining the elements to form a small array, the gain from the feed elements is increased. This creates a more narrow beam radiated from the feed elements into the lens. What results is called under-illumination. This basically means that the radiation beam of the element(s) feeding the lens is not as broad as it should be for optimal lens performance. This is a powerful tool that can be used to control the beamwidths of the energy radiated from the lens. FIG. 6B illustrates the impact of this approach to the beams radiated from the lens.

FIG. 7 illustrates all of the other concepts discussed with a multiband arrangement. Most mobile base station antennas are multiband to provide multiple wireless services from a single antenna. This antenna is no different. It is designed to be able to provide multiband functionality. Antenna elements generally get smaller as frequency is increased. Therefore, the smaller elements correspond to what we can call a high band (higher frequency), and the larger elements correspond to what we can call a low band (lower frequency). The radiation patterns are shown in FIG. 7B. Because the size of the lens determines the beamwidth of the radiation pattern, the lens is electrically larger for the high band elements than it is for the low band elements. Electrical size is determined in wavelengths ($\lambda=c/f$, where $\lambda$—wavelength, c—speed of light in a vacuum, and f is frequency). As frequency goes up, $\lambda$ gets smaller so objects becomes larger at higher frequencies. A lens that is 3 meters in diameter is approximately 10 wavelengths in diameter at 1 GHz. The same lens is 100 wavelengths in diameter at 10 GHz. So the lens doesn't change size physically, but it is electrically larger for higher frequencies. Due to all of this, the radiation beams are more narrow for higher frequencies (high band) and broader for lower frequencies (low band). The high band radiation beams are shown by the dashed lines in FIG. 7B, and the low band radiation beams are shown by the solid lines in FIG. 7B.

The different arrangements of elements 110 in FIGS. 1-7 correspond the desired functionality of the antenna system as a whole. These arrangements primarily determine how much overlap exists between neighboring beams. If the feed elements 110 are farther apart from each other, there is less overlap between beams. If the elements 110 are closer together, there is more overlap between beams.

With respect to FIGS. 8A-8F, a positioning system 800 can be provided to move the elements 110 to desired positions. For instance, the positioning system 800 can include a two-axis positioner 802 connected to a mounting system 810 that is connected to the lens body 102 through one or more support pillars or columns 814. The mounting system 810 may further include openings 812 that guide the support structure 120 during its movement. These openings 812 may further include ball bearings to allow the support structure 120 to easily slide through or along the openings 812. The two-axis positioner 802 is attached to a mounting plate 820 that includes four arms 822.

For example, the openings 812 can be horizontally-oriented slots in the top and bottom frame members. The slots can be curved to be substantially parallel to the surface of the lens body 102 and match the shape of the support structure 120. A top or top portion of the support structure 120 is slidably received in the slot at the top frame member and a bottom or bottom portion of the support structure 120 is slidably received in the slot at the bottom frame member. The slots are longer than the width of the support structure 120, so that the support structure 120 can slide side-to-side (or left/right) in the elevation direction with respect to the lens body 102. The support structure 120 can also slide up/down in the top and bottom slots in the azimuth direction with respect to the lens body 102. In addition, a vertically-oriented slot can be positioned in each of the side frame members that slidably receive the side or side portions of the support structure 120, which also allow movement in the elevation and azimuth directions. Movement of the support structure 120 is controlled by the positioner 802. In one embodiment, an extension structure such as one or more rods or curved plate can extend outward from the top, bottom and/or sides of the support structure 120 and be received in the slots to control movement of the support structure.

The four arms 822 attach to standoffs 830 that are attached to the support structure 120. The standoffs 830 further include an inner standoff 832 and an outer standoff 834, where the inner standoff 832 is slidably received in an opening of the outer standoff 834 and the inner standoff 832 controllably slides down into the outer standoff 834. The outer standoff 834 is connected to the support structure 120 by bolts, epoxy, or a weldment. The inner standoff 832 slides down into the outer standoff 834, but it does not connect to the support structure 120. Ball bearings can be included in the inner standoff 832 or outer standoff 834 to allow the inner standoff 832 to move into and out of the outer standoff 834, which in turn moves the support structure 120 away from and toward the lens body 102, respectively, by control of the positioner 802. This enables the two axis positioning system 800 to move linearly and provide spherical motion to the support structure 120 as it moves around the lens body 102 guided by the openings 812 in the mounting system 810. The connection between the inner standoff 832 and the arms 822 of the mounting plate 820 forms a ball joint to allow the inner standoff 832 to rotate with respect to the arms 822 as the support structure 120 moves.

Accordingly, the support structure 120 moves spherically around the surface of the lens body 102 guided by the openings 812 in the mounting system 810. The two axis positioning system 800 moves the mounting plate 820 in the azimuth and elevation directions, i.e., left/right and up/down. The inner standoff 832 moves in/out with respect to the outer standoff 834 so that the linear motion of the mounting plate 820 provided by the two axis positioning system 800 is translated to spherical motion for the support structure 120 which is guided by the openings 812 in the mounting structure 810.

Figure 9:
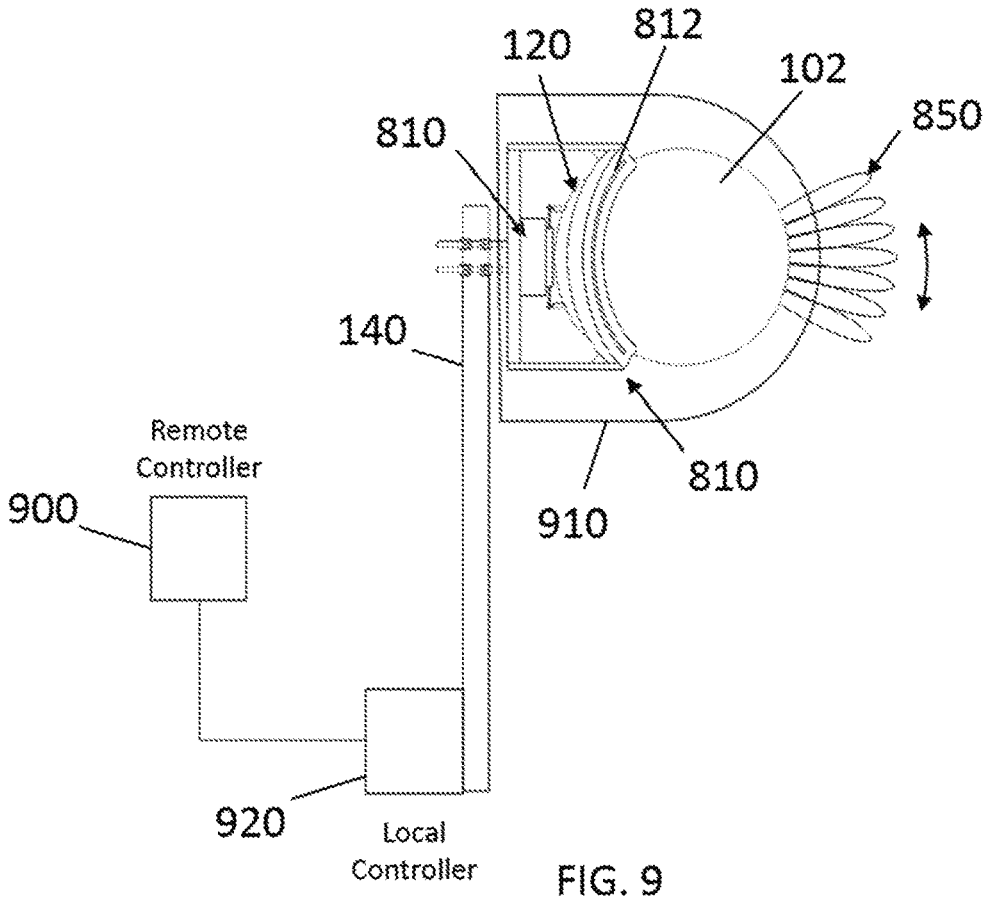
FIG. 9 is a block diagram for the antenna system with mechanical element position being remotely controlled.

Referring to FIG. 9, the present embodiment can further include a remote control system 900. The remote control system 900 is coupled to the positioning system to remotely reposition the antenna feed structure. A radome 910 can also be positioned covering the lens 100 and element support structure 120 to shield the system from the surrounding environment. The system further includes a local controller 920 positioned local to the multi-beam antenna system and in communication with the remote controller 900. The local controller 920 receives control signals from the remote controller 900 and moves the positioner 800 in response to those control signals. The local controller 920 can also be utilized to generate control signals from a local user, that also moves the positioning system 800.

The remote controller 900 and/or the local controller 920 and their functionalities can be implemented by a computer or computing device having a processor or processing device to perform various functions and operations in accordance with the invention. The computer can be, for instance, a personal computer (PC), server or mainframe computer. In addition to the processor, the computer hardware may include one or more of a wide variety of components or subsystems including, for example, a co-processor, input devices, monitors, wired or wireless communication links, and a memory or storage device such as a database. The system can be a network configuration or a variety of data communication network environments using software, hardware or a combination of hardware and software to provide the processing functions.

The lens body 102 is generally large (multiple wavelengths) in diameter. However, the lens size is determined by the desired gain or directivity of the secondary radiation beam. For example, a lens that is 4λ, in diameter will allow for a maximum directivity of approximately 22 dB, but a lens that is 10λ in diameter will allow for a maximum directivity of approximately 30 dB. Note that λ is the free-space wavelength. The size of the elements 110 is generally specific to the element type and also frequency dependent. In one embodiment of the invention, a rule of thumb for the element types is that the dipole arms are generally λ/2 at the central frequency of the operating band, and the total height is generally close to λ/4. These values can range by approximately ±10% without significant performance degradation. The focal surface is heavily dependent on the materials that make up the lens. For a true Luneburg lens, the focal surface lies on the outer surface of the lens body, but for lenses made of solid dielectric materials, this focal surface can change. Furthermore, this focal surface provides guidance on where to place the elements, but it does not provide an absolute value for the space d3 between the elements 110 and the lens outer surface 104. For the present embodiment, it is found that a distance d3 between the elements 110 and the lens outer surface 104 of approximately λ/4 is sufficient to provide a directivity of approximately 23 dB with a 6λ, lens composed of material with a dielectric constant of 2.3. Note that λ is the free-space wavelength.

The present invention provides several benefits for multibeam 5G antenna systems. Large, planar antenna arrays are a major focus for future wireless systems to provide; however, they suffer from some performance difficulties such as scan loss and scan blindness as the array scans to wide angles. Since the present is a spherical lens where the lens provides the beam shape and multiple elements provide multiple radiation beams to cover wide angles, there is no scan loss associated with electronically scanning a beam. If elements in the present invention are combined in an array to provide beam steering, there will be some scan loss associated with the beam steering. However, this is not required to achieve high gain, multibeam functionality.

Large antenna arrays also suffer from challenges in impedance matching since the active VSWR of the array changes as the array scans to various angles. This can lead to performance degradation as well as damage to sensitive RF components if the active VSWR is so bad that amplifiers become overloaded. Since the multibeam lens of the present invention does not require a large, steerable array to cover wide angles with multiple radiation beams, the problems associated with active VSWR can be avoided.

The lens of the present invention is well-suited for 5G applications for several reasons. The lens diameter to achieve a particular gain is inversely proportional to wavelength. Since wavelength gets smaller as frequency increases, the required lens size gets smaller with increasing frequency. This supports lens use for 5G since 5G applications are investigating frequencies from 3 GHz to millimeter wave. As frequency goes up, the cost of materials and machining for a lens decreases whereas the cost and complexity of arrays increases leading to a need for lens technology for high frequency 5G applications. Lens solutions have been proposed and implemented for many other applications, but there is a need for high gain, multibeam antenna solutions for 5G. Furthermore, the dual band, dual polarized lens of the present invention with capabilities for beamwidth control and mechanical beam steering will be crucial for 5G applications of the future.

It is further noted that the description uses several geometric or relational terms, such as spherical, curved, parallel, orthogonal, elongated, concentric, and flat. In addition, the description uses several directional or positioning terms and the like, such as inner, outer, azimuth, elevational, horizontal, and vertical. Those terms are merely for convenience to facilitate the description based on the embodiments shown in the figures. Those terms are not intended to limit the invention. Thus, it should be recognized that the invention can be described in other ways without those geometric, relational, directional or positioning terms. In addition, the geometric or relational terms may not be exact. For instance, the outer lens surface 104, elements 110 (or element portions 112, 114) and platform 122 may not be exactly perpendicular or parallel to one another but still be considered to be substantially perpendicular or parallel because of, for example, roughness of surfaces, tolerances allowed in manufacturing, etc. And, other suitable geometries and relationships can be provided without departing from the spirit and scope of the invention.

It is noted that various elements are described as being connected to each other by epoxy or adhesive. Those connections are intended to fixedly attach those elements to one another to form a rigid, reliable, and permanent attachment. One skilled in the art will recognize that other suitable fixed attachments may be appropriate other than epoxy or adhesive, such as fasteners, or integrally forming the elements as one piece or embedding one piece in the other. Thus, the specific connections are not intended to be limiting on the invention.

Within this specification, the terms "substantially" and "about" mean plus or minus 20%, more preferably plus or minus 10%, even more preferably plus or minus 5%, most preferably plus or minus 2%. In addition, while specific dimensions, sizes and shapes may be provided in certain embodiments of the invention, those are simply to illustrate the scope of the invention and are not limiting. Thus, other dimensions, sizes and/or shapes can be utilized without departing from the spirit and scope of the invention.

The foregoing description and drawings should be considered as illustrative only of the principles of the invention. The invention may be configured in a variety of shapes and sizes and is not intended to be limited by the preferred embodiment. The invention includes the antenna as well as the method of providing the antenna. Numerous applications of the invention will readily occur to those skilled in the art. Therefore, it is not desired to limit the invention to the specific examples disclosed or the exact construction and operation shown and described. Rather, all suitable modifications and equivalents may be resorted to, falling within the scope of the invention.

The invention claimed is:

1. A directive, multiple beam MIMO antenna system for 5G wireless voice and high speed data communications, the system comprising:

a spherical dielectric lens;

a plurality of dual polarized antenna elements;

one or more element support structures that support said plurality of dual polarized antenna elements; and one or more positioning systems for selectively moving the one or more element support structures in a rotational manner with respect to a center of the spherical dielectric lens to modify the position of said plurality of antenna elements and their corresponding secondary beams altering the coverage area provided by said MIMO antenna wherein two or more of the plurality of antenna elements are electronically combined to modify secondary beam shape and position.

2. The antenna system of claim 1, wherein the spherical dielectric lens is monolithic and comprised of a single dielectric material with a substantially homogeneous dielectric constant.

3. The antenna system of claim 1, wherein the spherical dielectric lens has one or more layers of substantially homogenous dielectric material or one or more dielectric constants surrounding a core of substantially homogeneous dielectric material or dielectric constant.

4. The antenna system of claim 1, wherein the spherical dielectric lens is fabricated from single or multiple dielectric materials using subtractive manufacturing methods to synthesize a radially varying dielectric constant that resembles the dielectric constant of the Luneburg lens.

5. The antenna system of claim 1, wherein the plurality of antenna elements radiate electromagnetic energy at frequencies of 3 GHz and above corresponding to 5G applications.

6. The antenna system of claim 5, wherein the plurality of antenna elements and corresponding feed network are configured for dual linear polarization at ±45°.

7. The antenna system of claim 5, wherein the plurality of antenna elements in their entirety are arranged linearly in rows and/or columns.

8. The antenna system of claim 5, wherein the plurality of elements are arranged in a partially linear manner for enhanced spherical coverage.

9. The antenna system of claim 1, wherein the plurality of antenna elements and corresponding feed network are configured for single linear polarization.

10. The antenna system of claim 1, wherein the plurality of antenna elements and corresponding feed network are configured for circular polarization.

11. The antenna system of claim 1, wherein the plurality of antenna elements includes a combination of linearly polarized and circularly polarized elements.

12. The antenna system of claim 1, wherein the plurality of antenna elements are passive antenna elements.

13. The antenna system of claim 1, wherein the plurality of antenna elements include a combination of active and passive antenna elements.

14. The antenna system of claim 1, wherein the plurality of the antenna elements operate in two or more distinct frequency bands.

15. The antenna system of claim 1, wherein the plurality of antenna elements comprise distinct antenna elements for distinct bands of operation.

16. The antenna system of claim 1, wherein the plurality of antenna elements comprise at least two antenna elements operating in the same frequency band are combined for secondary beam control.

17. The antenna system of claim 1, wherein the plurality of antenna elements includes only a single element type for broadband coverage.

18. The antenna system of claim 1, wherein the plurality of antenna elements include a single antenna type.

19. The antenna system of claim 1, wherein the plurality of antenna elements include antennas of different types.

20. The antenna system of claim 1, further comprising a radome to shield the plurality of antenna elements and the spherical dielectric lens from the environment.

21. The antenna system of claim 1, wherein the one or more element support structures provide an RF ground for the plurality of antenna elements.

* * * * *